US006132255A

United States Patent [19]

Verhoeven

[11] Patent Number: 6,132,255

[45] Date of Patent: Oct. 17, 2000

[54] CONNECTOR WITH IMPROVED SHIELDING AND INSULATION

[75] Inventor: Laurentius M. Verhoeven, Veghel, Netherlands

[73] Assignee: BERG Technology, Inc., Reno, Nev.

[21] Appl. No.: 09/227,907

[22] Filed: Jan. 8, 1999

[51] Int. Cl.[7] ..... H01R 13/648

[52] U.S. Cl. ..... 439/608

[58] Field of Search ..... 439/607, 608, 439/609, 610, 701

[56] References Cited

U.S. PATENT DOCUMENTS

| | | | |
|---|---|---|---|
| 5,171,161 | 12/1992 | Kachlic | 439/352 |
| 5,236,375 | 8/1993 | Kachlic | 439/607 |
| 5,310,354 | 5/1994 | Oswald, Jr. | 439/608 |
| 5,593,311 | 1/1997 | Lybrand | 439/295 |
| 5,605,476 | 2/1997 | McNamara et al. | 439/608 |
| 5,628,653 | 5/1997 | Haas et al. | 439/607 |
| 5,795,191 | 8/1998 | Preputnick | 439/608 |
| 5,842,887 | 12/1998 | Andrews | 439/608 |

*Primary Examiner*—Lincoln Donovan
*Assistant Examiner*—Javaid Nasri
*Attorney, Agent, or Firm*—Woodcock Washburn Kurtz Mackiewicz & Norris LLP

[57] ABSTRACT

A shielded connector for electrically interconnecting electrical components or printed circuit boards, or electrically connecting electrical components to printed circuit boards is shown to include a terminal layer having a plurality of contact terminals. First and second insulating layers are positioned on either side of the terminal layer. A plurality of shield walls are oriented to pass through the first and second insulating layers and to pass between the contact terminals. A side shield is positioned along side the shield walls and electrically connected along one edge to the side shield. The column assembly is mounted in a housing. In a preferred embodiment, a second side shield is positioned on the side of the shield walls opposite the electrically connected edge. In such an embodiment, it is also preferred to combine two columns in a manner that sandwiches an insulating layer. The layered structure is preferably constructed to constitute a right angle connector when mounted in a housing. In an especially preferred embodiment, the shielded connector is constructed from a series of lead frames.

16 Claims, 8 Drawing Sheets

FIG. 1C
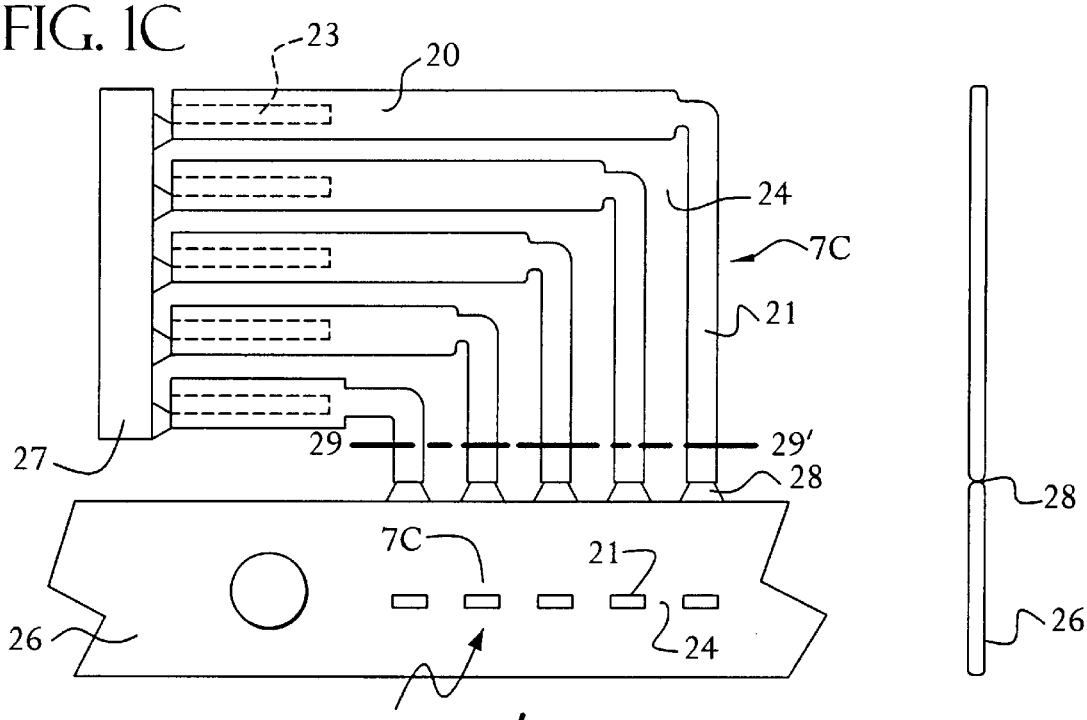
FIG. 1C′
FIG. 1C″
FIG. 1B
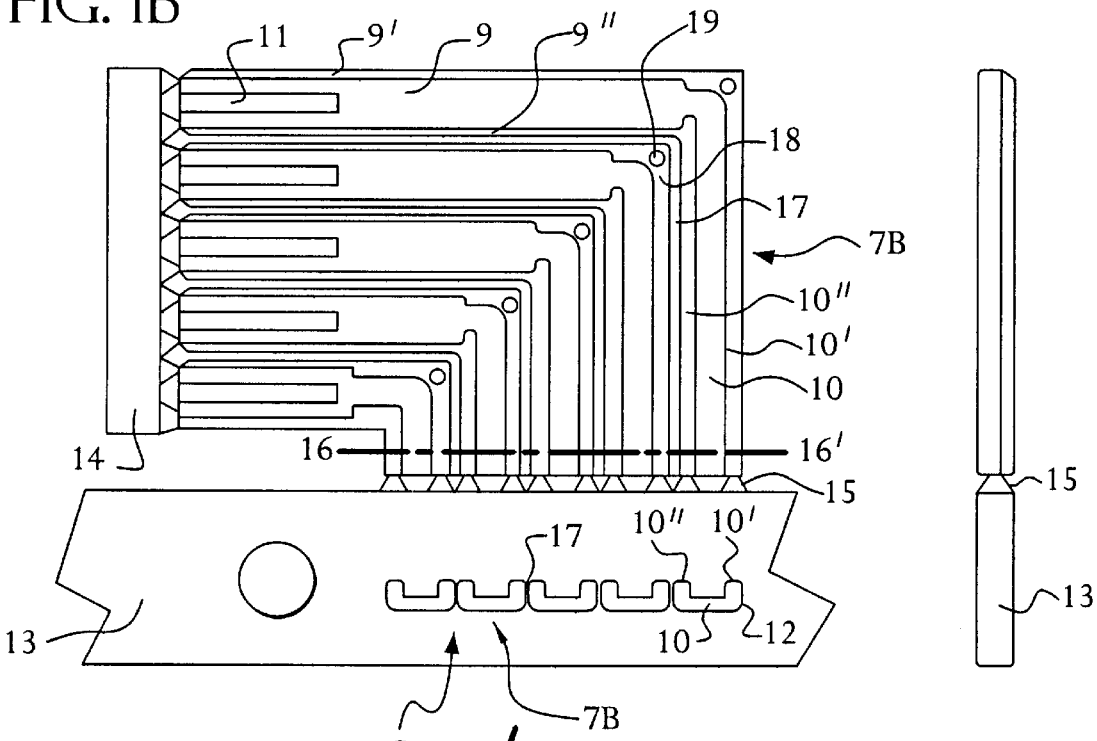
FIG. 1B′
FIG. 1B″

CONNECTOR WITH IMPROVED SHIELDING AND INSULATION

RELATED APPLICATION

The present invention is related by subject matter to the invention disclosed in commonly assigned application having Ser. No. 09/227,638, filed concurrently on Jan. 8, 1999, entitled "Shielded Connectors and Method for Making the Same" incorporated herein by reference.

FIELD OF THE INVENTION

The present invention relates to connectors for use in digital electronic signal implementation, and more particularly to connectors used for interconnecting printed circuit boards by means of electrically shielded connectors.

BACKGROUND OF THE INVENTION

Digital electronic signal implementation has spurred technology changes within the telecommunications field as well as changes in sensitive electronic instrumentation. As clock-speed in digital circuitry increases, so do the problems in maintaining signal integrity such as controlling mutual cross-talk or reflection (impedance mismatch) between signal carrying conductors.

There also has been a desire to miniaturize electronic devices and to increase the number of discrete functions performed by a single device. These latter desires have resulted in more electronic functions being performed within a smaller cabinet volume, specifically within a limited surface space on a printed circuit board (PCB). This has lead to more signal interaction and thus greater disruption between neighboring components within the confined space, or the multi-functional devices themselves may be influenced by neighboring equipment.

Older connector designs were based on the flow of low frequency signals (around 50 Hz) using relatively high voltage and high current levels. Contemporary digital signals operate at high frequency (approaching 1 GHz) with signal amplitude on the order of microvolts. With such high speed, low voltage signals, transmission can occur from the "outer skin" of a conductor. In such cases, the impedance characteristics of the interconnect is important.

New multi-function connectors mounted on a PCB and limited to a defined cabinet space are subject to the problems associated with the technology advances described above. Shielded connectors that allow circuitry to attain characteristics allowing for the propagation of high-speed signals, have set the pace for connector designers and manufacturers.

In response to the forces of digital signal implementation and miniaturization, connector designers have paid particular attention to the telecommunications problem of crosstalk. One design limitation has been the shielding for the electronic signal element (and connector terminal path). Ideally, the signal element needs to be enclosed by an equally-spaced air gap (the best possible dielectric) in the form of an annulus bounded by a metal shield. There has been a gradual drift toward using coaxially-shielded components for placement on a PCB or in other equipment.

Optimal coaxial shielding is achieved by a circular cross-section connector (or cylindrical longitudinal inter-connect) with virtually no cross-sectional change over its length. As such, the distance between the center of the connector (where the signal resides) and the shielding is preferably uniform over the length of the connector with no constriction in flow of signal. Usually these types of connectors are relatively expensive machine-turned connectors.

Most connectors, however, use stamped components that are easy and cost-effective to manufacture. Typically, in such stamped structures, the internal contact terminals are rectangularly shaped and thereby deviate from the ideal annular structure. Shielding such contacts requires an equally-spaced dielectric resulting in a rectangular shield structure. There is also a deviation from the ideal circular cross-section because of the diagonal distance from the signal conductor to the shield at a corner. This non-ideal shielding is referred to as pseudo-coaxial. In most connector applications, because of the rectilinear contact pitch requirements, shielding is of the pseudo-coaxial type. It is, therefore, desirable to provide shielding for a pseudo-coaxial connector that simulates the ideal coaxial environment as closely as possible.

One problem in pseudo-coaxial connector design is that changes in cross-section within the uniformly-extending outer casing cause impedance changes, resulting in reflection loss of the signal. It is, therefore, also desirable to provide a connector that avoids such impedance changes in the connection from PCB to PCB or from PCB to component.

Right angle or horizontal (straight) connectors such as Metral™ connector receptacles, manufactured by FCI/Berg Electronics Group, Inc. of Valley Green, Pa., are commonly utilized for many telecommunication backplane applications. Backplane connectors are generally designed to have a high density multi-pin input/output structure to interconnect a telecommunications backplane to a daughter card.

Therefore, a need still exists for a right angle or straight connector having shielding between rows and columns that addresses all of the above-described problems with prior connectors, thereby providing a pseudo-coaxial connector design that simulates the ideal coaxial structure. There also is a need for a shielded connector that is relatively inexpensive to manufacture.

SUMMARY OF THE INVENTION

The present invention concerns the development of a shielded receptacle whereby an assembly is constructed based on the leadframe concept, and particularly a right angle or straight pseudo-coaxial connector that simulates the ideal coaxial structure based on the leadframe concept. As used here, the word "leadframe" is derived from the integrated circuit industry's use of closely spaced leads stamped or otherwise formed on a carrier such that they remain integrated and held in position to facilitate placement and manufacture. At a desired point in the manufacturing process, the carrier is severed from the terminal leads.

The above described problems are resolved and other advantages are achieved in a shielded connector for electrically interconnecting electrical components or printed circuit boards, or electrically connecting electrical components to printed circuit boards. The shielded connector is shown to include a terminal layer having a plurality of contact terminals. First and second insulating layers are positioned on either side of the terminal layer. A plurality of shield walls are oriented to pass through the first and second insulating layers and to pass between the contact terminals. A side shield is positioned along side the shield walls and electrically connected along one edge to the side shield. The column assembly is mounted in a housing.

In a preferred embodiment, a second side shield is positioned on the side of the shield walls opposite the electrically connected edge. In such an embodiment, it is also preferred to combine two columns in a manner that sandwiches an insulating layer. The layered structure is preferably constructed to constitute a right angle connector when mounted in a housing.

In an especially preferred embodiment, the shielded connector is constructed from a series of lead frames. An ultimate purpose of the present invention is to use the leadframe concept to develop modules, each of which consists of two columns interposed by a flat dielectric material.

It is also preferable for the shielded connector to include at least one fixing member placed through the first and second insulating layers, the first side shield, and the second side shield for holding each column together. Preferably, the fixing member is a fixing stud or a rivet.

BRIEF DESCRIPTION OF THE DRAWINGS

The present invention will be better understood and its numerous objects and advantages will become apparent by reference to the following detailed description of the invention when taken in conjunction with the following drawings, in which:

FIG. 1B is a side view of a bottom plastic insulator of the present invention.

FIG. 1B' is a cross-sectional bottom view of the plastic insulator of FIG. 1B.

FIG. 1B" is a rear view of the plastic insulator of FIG. 1B.

FIG. 1C is a side view of a top plastic insulator of the present invention.

FIG. 1C' is a cross-sectional bottom view of the plastic insulator of FIG. 1C.

FIG. 1C" is a rear view of the plastic insulator of FIG. 1C.

FIG. 1D' shows a rear view of the metal stamp of FIG. 1D.

DETAILED DESCRIPTION OF THE PREFERRED EMBODIMENTS

Figure 1:
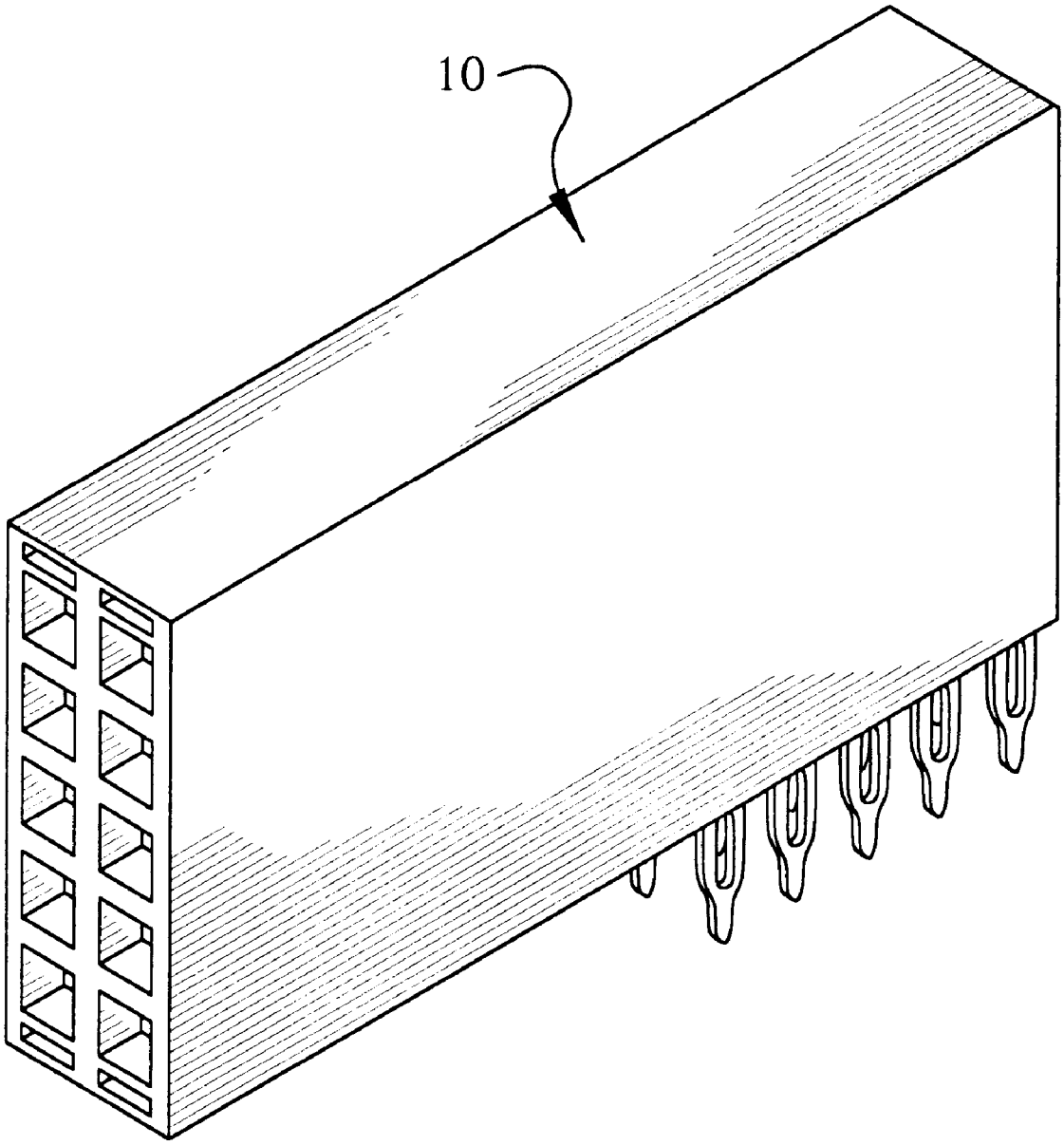
FIG. 1 is a perspective view of an electrical connector according to the invention.

A shielded connector 10 is generally shown in FIG. 1. FIGS. 1A–1H depict parts that are assembled together to form one module of shielded connector 10 according to the present invention. As evident from the figures, connector 10 is based on the leadframe design concept.

Figure 1A:
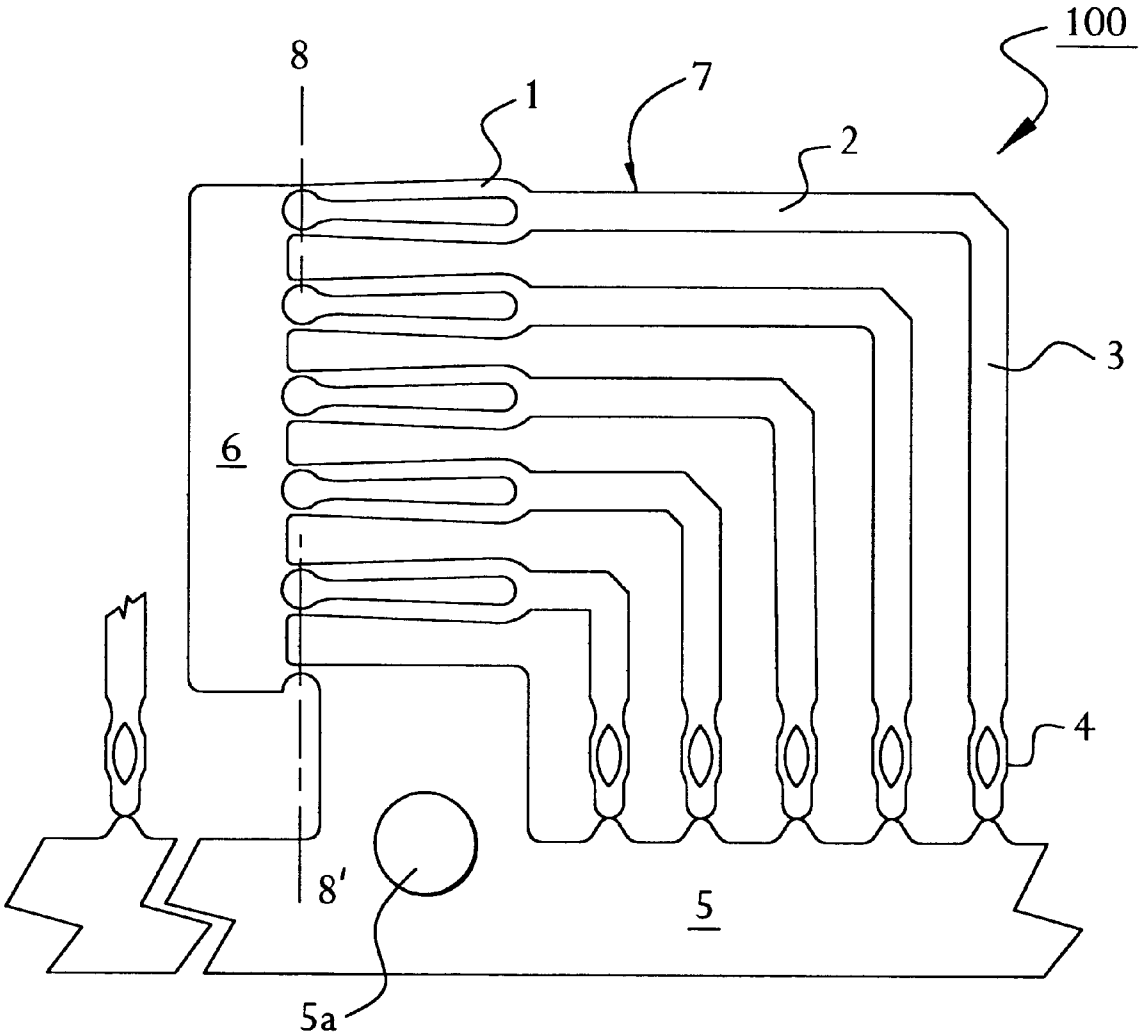
FIG. 1A is a side view of a column of terminals used for the shielded connector of the present intention, depicting the tuning fork terminals.

FIG. 1A shows leadframe 100 to include a number of contact terminals 7. Each contact terminal 7 includes a tuning fork-shaped receptacle portion 1 attached to leg portion 2, which in turn, adjoins leg portion 3. A press fit-shaped terminus 4 is attached to the end of leg portion 3. Terminus 4 is also connected to a carrier 5 with pilot holes 5*a*. Carrier 6 is attached to the five receptacle portions 1. Preferably leadframe 100 is formed in a stamping operation. In such an operation, the carrier 6 serves to primarily assist for terminal contour and gap sizing operations and for the plating operation. Carrier 6 is designed to be broken off along line 8–8' prior to final assembly to yield individual terminals 7.

Leadframe 100 has associated insulating structures 7B and 7C, as shown in FIGS. 1B and 1C, respectively. The insulating structures are also formed on the basis of the leadframe concept.

FIG. 1B shows plastic insulator half 7B which consists of two legs 9 and 10 perpendicular to each other and each having respective upstanding side walls 9', 9" and 10', 10". If a section were to be viewed from the bottom along line 16–16', a series of U-shaped cross sections 12 (as shown in FIG. 1B' displayed inset on bottom carrier 13) are visible with air openings 17. It will be appreciated from FIG. 1B, that openings 17 preferably extend the full length between adjacent plastic legs 9 and 10.

Figure 1D:
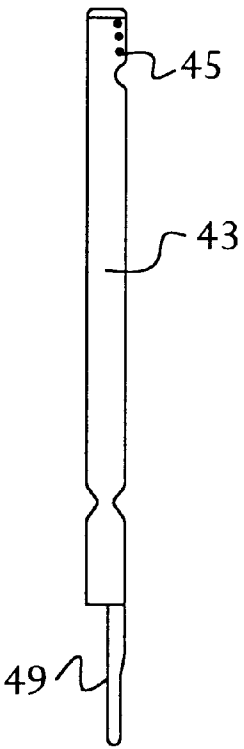
FIG. 1D is a side view of a metal stamp to be incorporated between rows of the present invention.
Figure 1D:
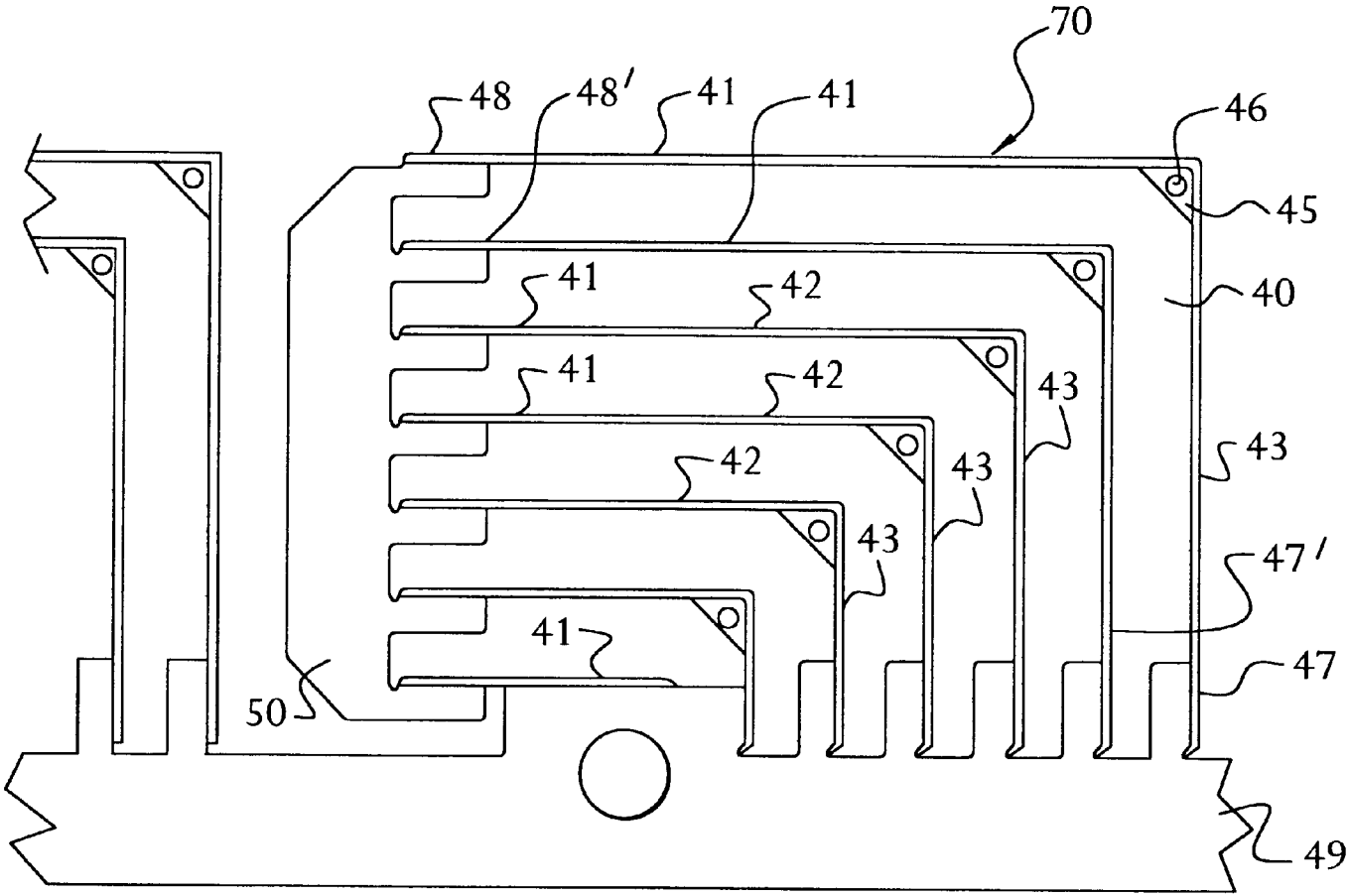
Figure 1E:
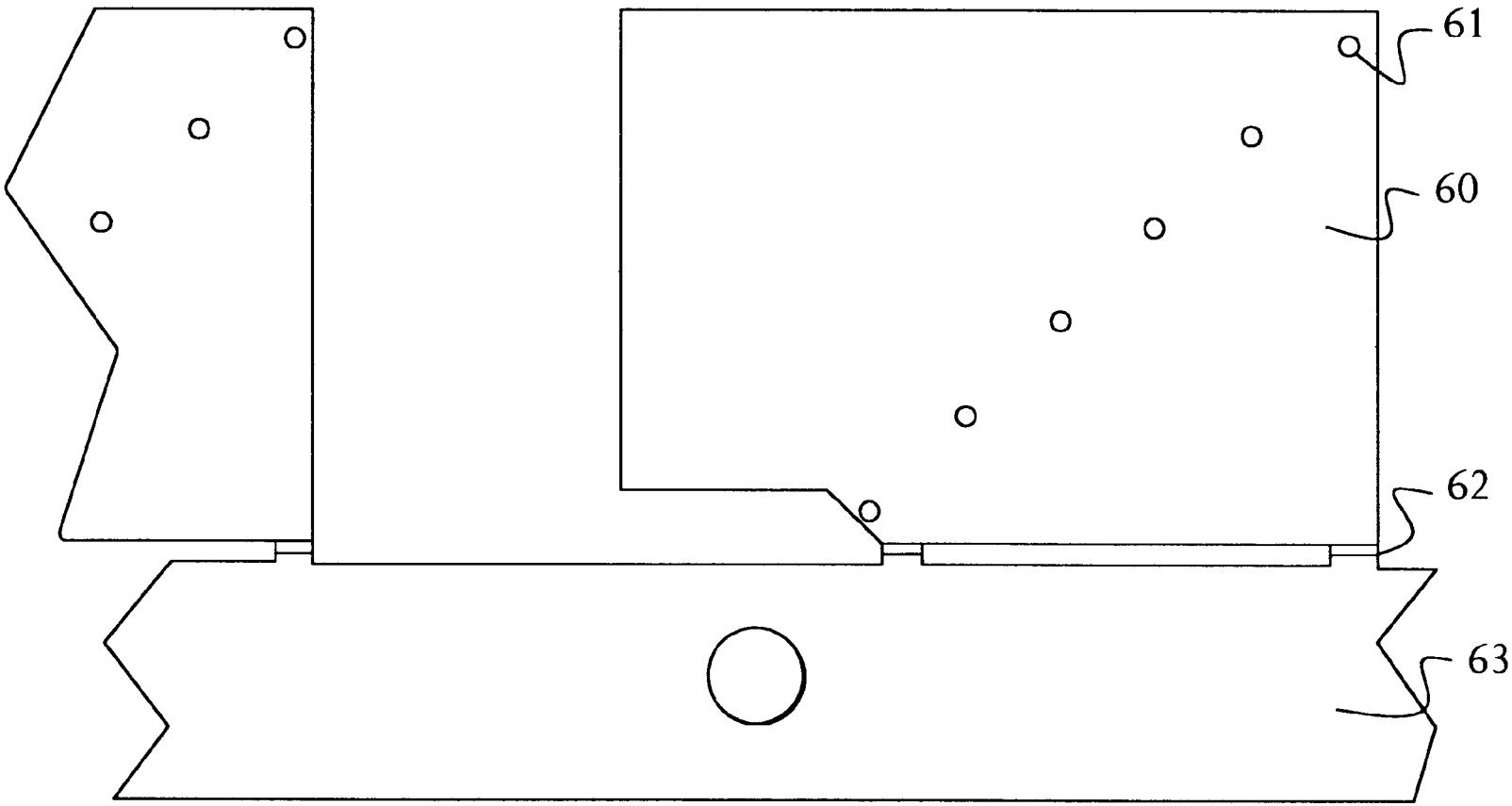
FIG. 1E is a side view of side shields of the present invention.
Figure 1G:
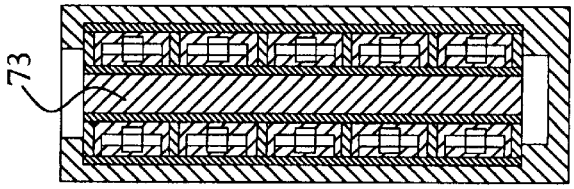
FIG. 1G is a cross-sectional rear view of the completed assembly of FIG. 1F.
Figure 1F:
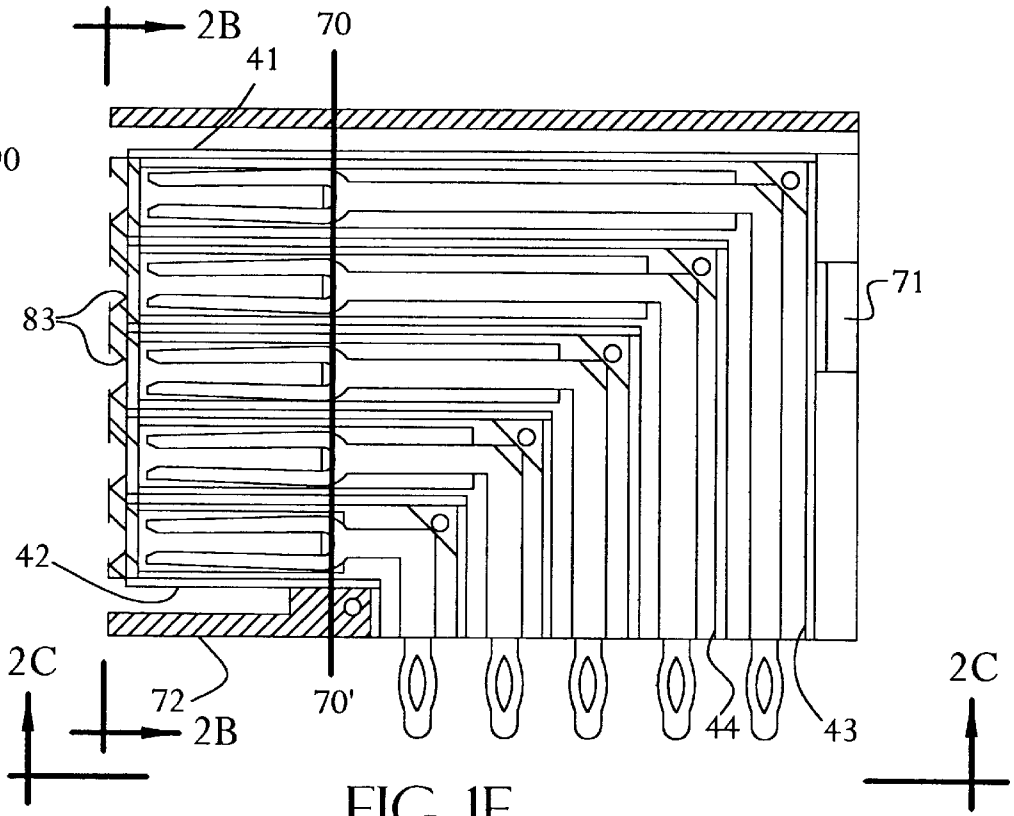
FIG. 1F is a cross-sectional schematic side view of a complete assembly of a column of the shielded connector of the present invention.

Each leg 9 has a recessed area 11 over its partial length to accommodate a mating plug pin (depicted as 93 in FIG. 1F). Each plastic leg 9 has a corner flat 18. Each flat 18 has a bore 19, positioned so that each lies along a diagonal line. The number of plastic legs correspond to the number of desired rows for a connector column, and are joined by break-away stubs 15 to the bottom carrier 13. The forward or receptacle end of legs 9 are held in position by joining carrier 14. Both carriers 13 and 14 may be broken off during the connector assembly procedure. A rear view of the insulator 7B is shown in FIG. 1B".

FIG. 1C shows the plastic insulator half 7C, again according to the leadframe concept, joined to a bottom carrier 26 by break-away stubs 28. Each plastic insulator 7C includes a plurality of flat insulator segments. Each segment includes a leg 20 and a leg 21. A recessed zone 23 (for mating plug pin 93) is formed at the forward end of leg 20. Bottom carrier 26 joins legs 21. The cross-sectional view from the bottom along line 29–29' is shown in FIG. 1C'. As shown in FIG. 1C' air spaces 24 are defined between adjacent legs 20 and 21. A rear view of the insulator 7C of FIG. 1C is shown in FIG. 1". It is noted that the height of sidewalls 9', 9", 10' and 10" is preferably sufficient so that a contact terminal 7, when sandwiched between insulating halves 7B and 7C, will be surrounded by insulating material.

FIG. 1D shows leadframe 7D for shielding to be incorporated in the column assembly between rows. Leadframe 7D is preferably formed from metal and stamped to create bottom carrier 49 and carrier 50 to vertically adjoin the separate row shields 41. Each row shield 41 includes arms 42 and43. Arms 42 and 43 are joined to carriers 49 and 50 by break-away portions 47 and 48, respectively. A rear view of the metal stamp 7D of FIG. 1D is shown in FIG. 1D'.

At the junction of arms 42 and 43 are located metal flats 45 with bores 46, which have positional and diagonal correspondence with the bores 19 formed in plastic insulator half 7B. During column assembly, both carriers 49 and 50 can be broken off to have accurately formed and positioned L-shaped row shields with flats 45 to connect with the remainder of the assembly.

FIG. 1E shows metal shields 60 adjoined to bottom carrier 63 by break-away portions 62. Holes 61 are located along the imaginary diagonal line corresponding to above-mentioned assembly parts.

FIG. 1F shows the cross section of an assembled column for eventual insertion in connector 10. During assembly, metal row shields 41 of FIG. 1D are inserted within the L-shaped air spaces 17 (FIG. 1B') of insulator half 7B. The separate terminals 7 of leadframe 100 are laid in plastic insulator half 7B. The plastic insulator half 7C is positioned and laid on the open side of the U-shaped channels formed in plastic insulator half 7B, terminals 7 are sandwiched there between. Two side shields 60 of FIG. 1E are positioned on each side of the assembly to form a sandwich or layered structure. Plastic fixing studs or rivets for all rows are placed in the assembly holes 19, 46 and 61 to hold the assembly together.

Figure 1H:
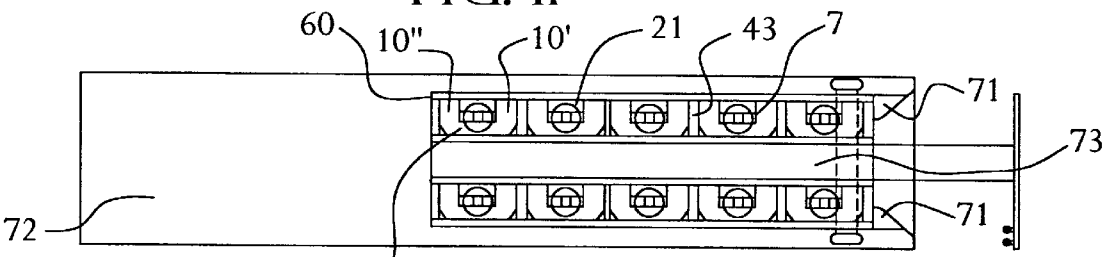
FIG. 1H is a bottom view of the complete assembly of FIG. 1F.

FIG. 1H shows the bottom view of the complete assembly. Such a module can be inserted into a front housing 72. A side view of the housing is shown in FIG. 1J. Knocks 71 are provided to longitudinally hold the module in place. As shown in FIG. 1J, plug pin guiding surfaces 83 are provided for the mating plug pins 93. Two columns of the present invention may be sandwiched on either side of a flat dielectric 73, as shown in FIG. 1G, a cross-sectional rear view along line 70–70' of FIG. 1F.

Figure 1I:
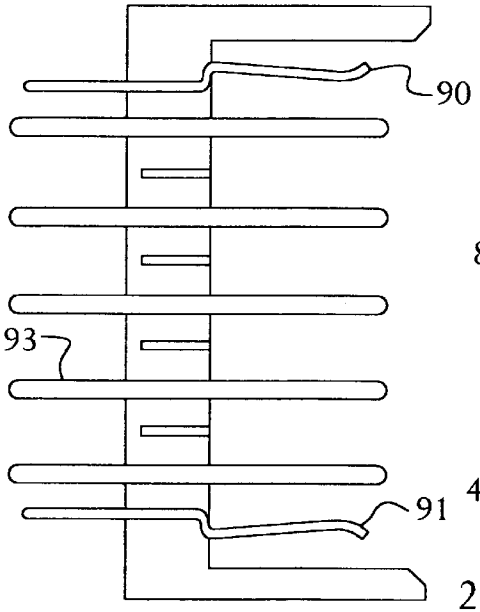
FIG. 1I is a cross-sectional side view of a plug to which the shielded connector of the present invention mates.
Figure 1J:
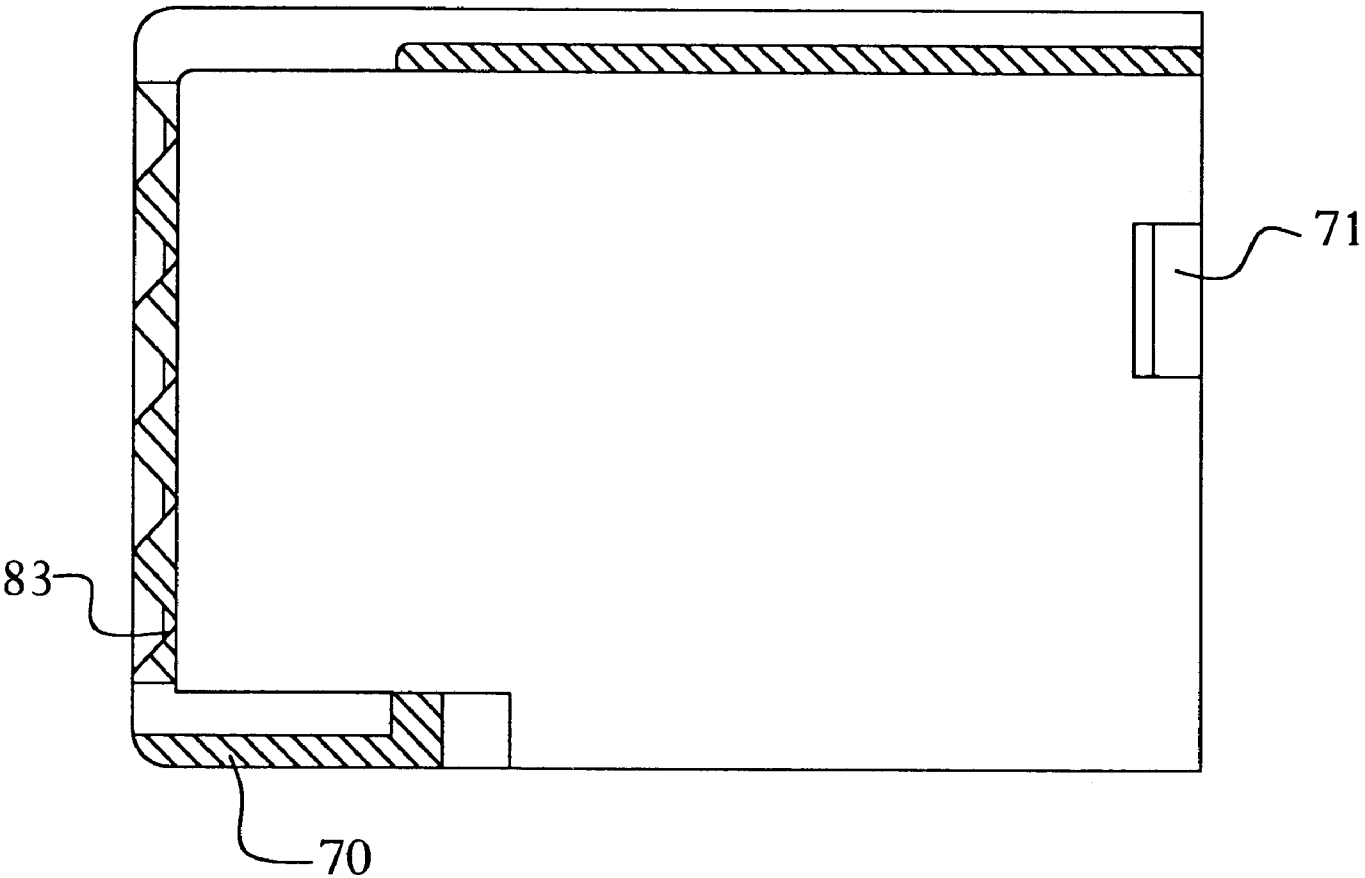
FIG. 1J is a side view of a housing for the shielded connector of the present invention.

FIG. 1I shows a cross-sectional side view of a plug to which the shielded connector mates. The plug has plug side shields 90 and 91, which during mating, contact the row shields 41. The plug pins 93 are either round or square in cross-section.

Figure 2B:
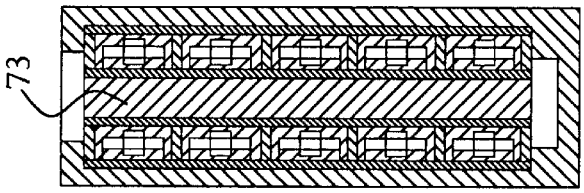
FIG. 2B is a cross-sectional rear view of the mating of FIG. 2A.
Figure 2A:
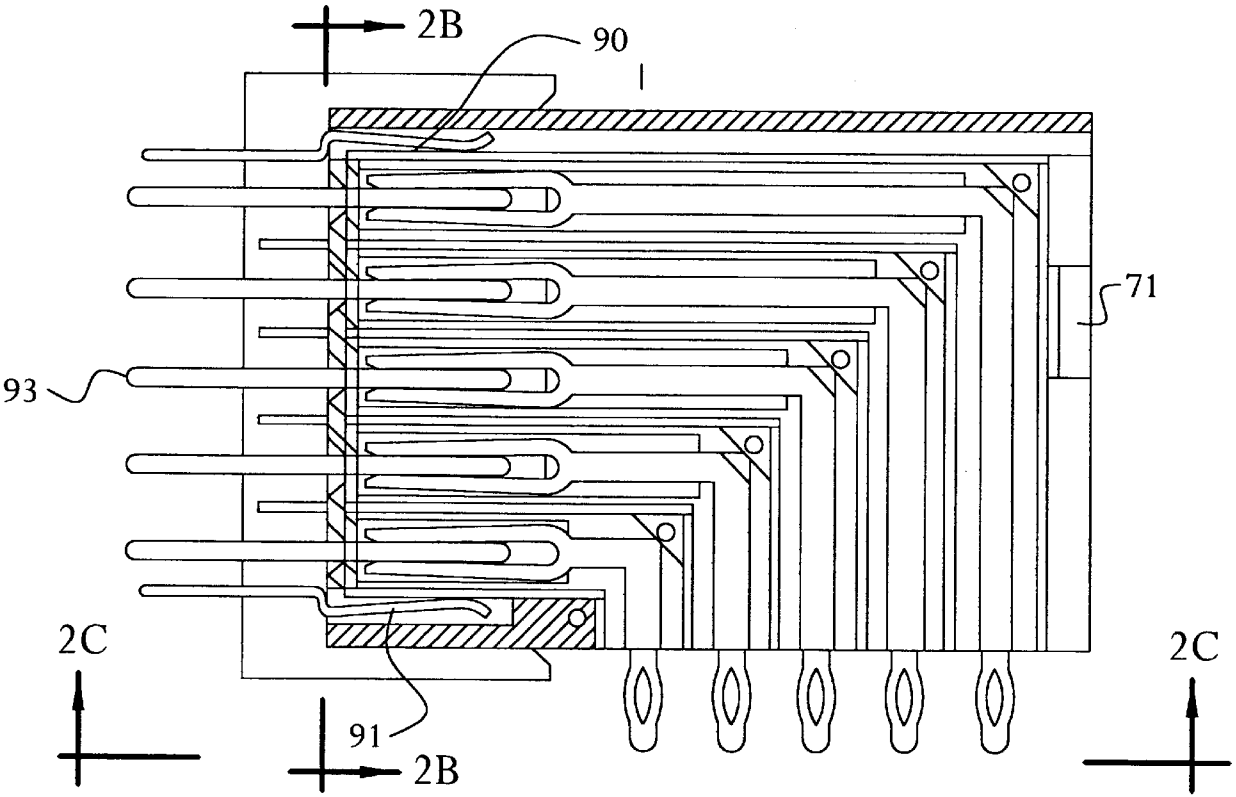
FIG. 2A is a cross-sectional side view of the mating the connector of FIG. 1F and the plug of FIG. 1I.
Figure 2C:
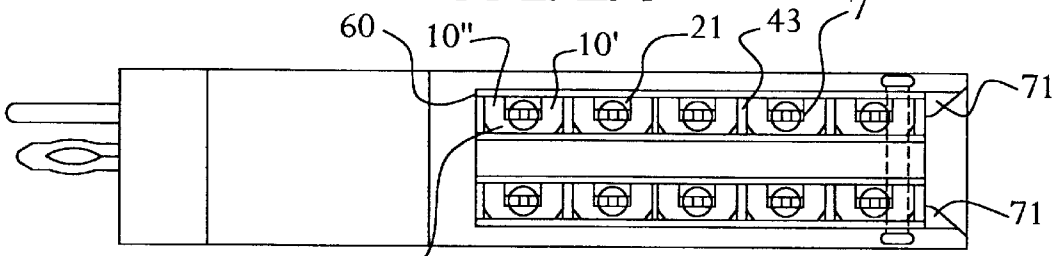
FIG. 2C is a bottom view of the mating of FIG. 2A.

FIG. 2A shows the cross-sectional view of the mating of the shielded connector of FIG. 1F and the plug of FIG. 1I FIG. 2B shows the cross-sectional rear view of the mating, and FIG. 2C shows the bottom view of the mating.

By being constructed from layers of stamped contact terminals, plastic and shields, the shielded connector of the present invention is relatively inexpensive to manufacture. The present invention also provides a right angle connector that simulates a coaxial environment by having shielding between rows and columns, and limits the normal impedance changes through the connection.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed. For example, although the invention was described above by reference to a right-angle connector, a connector according to the present invention can also be a straight connector or a connector of any desired shape.

What is claimed is:

1. A shielded connector, comprising:

a terminal layer having a plurality of contact terminals;

a first discrete insulating layer of plastic material positioned on a first side of said terminal layer;

a second discrete insulating layer of plastic material positioned on a second side of said terminal layer;

a plurality of shield walls oriented to pass through said first and second insulating layers and to pass between said contact terminals;

a side shield, wherein each of said shield walls is electrically connected along respective first edges to said side shield, wherein said terminal layer, said first and second insulating layers, said shield walls and said side shield define a first column; and a housing adapted to receive said column.

2. The shielded connector of claim 1, further comprising a second side shield positioned on respective second edges of said shield walls opposite said first edges.

3. The shielded connector of claim 2 further comprising a second column, said second column identical to said first column in its constituent components and positioned adjacent said first column.

4. The shielded connector of claim 2, further comprising at least one fixing member placed through holes in said first insulating layer, said side shield and said second side shield to provide for holding the assembly together.

5. The shielded connector of claim 4, wherein said at least one said fixing member comprises a fixing stud.

6. The shielded connector of claim 4, wherein said at least one said fixing member comprises a rivet.

7. The shielded connector of claim 1, wherein said shield walls and said side shield are formed from metal.

8. The shielded connector of claim 1, wherein each of said contact terminals comprises a receptacle end and a tail end, wherein the receptacle ends lie substantially along a receptacle line and the tail ends lie substantially along a tail line and wherein said receptacle line and said tail line are oriented at a right angle.

9. The shielded connector of claim 1, wherein said first and second insulating layers are shaped to surround said contact terminals.

10. A shielded connector assembly, comprising:

a first lead frame comprising a plurality of contact terminals;

a second lead frame comprising a plurality of discrete first plastic insulators;

a third lead frame comprising a plurality of discrete second plastic insulators;

a fourth lead frame comprising a plurality of shield walls oriented to pass between said contact terminals, said first insulators and said second insulators; and a side shield positioned so that said shield walls are electrically connected along respective first edges to said side shield.

11. The shielded connector assembly of claim 10, wherein said plurality of first insulators and said plurality of second insulators are shaped complementary to said contact terminals.

12. A method for manufacturing a shielded connector, comprising:

providing a first lead frame including a plurality of contact terminals attached to a first carrier;

providing a second lead frame including a plurality of discrete first insulators attached to a second carrier;

providing a third lead frame including a plurality of shield walls attached to a third carrier, wherein said plurality of shield walls are oriented to pass between said plurality of contact terminals and said plurality of first insulators;

providing a side shield positioned so that said shield walls are electrically connected along respective first edges to said side shield; and removing said first, second and third carriers.

13. The method of claim 12, further comprising the step of mounting said first, second and third lead frames and said side shield in a housing.

14. The method of claim 12, further comprising the step of providing a fourth lead frame including a plurality of discrete second insulators attached to a fourth carrier.

15. The method of claim 14, further comprising the step attaching said plurality of first insulators to said plurality of side walls and attaching said plurality of side walls to said side shield.

16. The method of claim 15, wherein said step of attaching comprises the step of providing a fixing member.

* * * * *